United States Patent [19]

Isler et al.

[11] Patent Number: 4,664,573

[45] Date of Patent: May 12, 1987

[54] MINE WALL SUPPORT ANCHOR

[75] Inventors: Erwin Isler; Hans R. Wey, both of Rapperswil, Switzerland

[73] Assignee: H. Weidmann AG, Rapperswil, Switzerland

[21] Appl. No.: 816,777

[22] Filed: Jan. 7, 1986

[30] Foreign Application Priority Data

Jan. 17, 1985 [CH] Switzerland ..... 247/85

[51] Int. Cl.[4] ..... F16B 33/02

[52] U.S. Cl. ..... 411/5; 411/903

[58] Field of Search ..... 405/259, 260, 261; 411/385, 386, 5, 3, 2, 496, 499, 896, 903, 537, 542, 383, 392, 901, 914

[56] References Cited

U.S. PATENT DOCUMENTS

| | | | |
|---|---|---|---|
| 731,896 | 6/1903 | Hass | 411/896 |
| 3,296,048 | 1/1967 | Wolfe | 411/903 |
| 4,295,761 | 10/1981 | Hansen | 405/261 |
| 4,313,697 | 2/1982 | Rozanc | 405/261 |
| 4,347,020 | 8/1982 | White et al. | 411/5 |
| 4,488,843 | 12/1984 | Achille | 411/385 |
| 4,523,880 | 6/1985 | Isler | 405/259 |

FOREIGN PATENT DOCUMENTS

| | | | |
|---|---|---|---|
| 0015895 | 9/1980 | European Pat. Off. . | |
| 0094906 | 11/1983 | European Pat. Off. . | |
| 1197548 | 12/1959 | France . | |
| 1327230 | 4/1963 | France . | |
| 7140425 | 5/1973 | France . | |
| 1261 | of 1898 | United Kingdom | 411/499 |

*Primary Examiner*—James L. Ridgill, Jr.
*Attorney, Agent, or Firm*—Sughrue, Mion, Zinn, Macpeak & Seas

[57] ABSTRACT

An adhesive anchor comprises a tie rod 1 having a thread casing 3, a pressure nut 5 and a pressure plate 7. The thread casing is saw tooth shaped with steep flanks 33 facing the tie rod free end and flat flanks 31 facing away from it. The turns of the thread casing are wedged between the thread body 11 of the nut and the tie rod, considerably improving the transfer of forces between the casing and the rod. The anchor is especially suitable for the securing of gallery walls in coal mines.

9 Claims, 5 Drawing Figures

MINE WALL SUPPORT ANCHOR

BACKGROUND OF THE INVENTION

In mining and the working of rock walls, forces are released that can cause rock to move into adjacent free space. To prevent this, anchors are built into blast holes. One such adjustable anchor is disclosed in European patent No. 94,908, wherein one end of a tie rod is fastened to the bottom of the blast hole by an expanding element and the other end is provided with a thread, on which a nut is screwed. The nut is adjacent to a washer plate that bears against the wall of the mine.

Adhesive anchors are also known, wherein the tie rod is, throughout its entire length, cemented to the wall of the blast hole by a two-component adhesive. With these anchors, a nut screwed onto the free end of the tie rod only prevents the wall of the hollow space from crumbling by means of a washer plate, thus having to transfer forces that are considerably smaller. The adhesive is first introduced into the blast hole, packed into plastic bags. At its anterior end the tie rod is provided with cutting edges which, when the rod is introduced into the hole, cuts open the bags. By turning the tie rod in the blast hole, both adhesive components are mixed and the mixture is then distributed over the entire dimension and length of the rod. After the adhesive mixture has hardened, the nut can be tightened.

In European patent No. 94,908 the tie rod is made from a glass fiber reinforced, synthetic material. In addition to high sturdiness and low weight, this also has the advantage that the tie rod does not corrode. Difficulties are caused, however, by the transfer of forces from the tie rod to the nut. To overcome this problem a casing is cast onto the end of the tie rod and features a saw tooth shaped thread whose flanks, not facing the tie rod's free end, are considerably steeper than those facing the free end. The casing is secured on the tie rod by saw tooth shaped grooves, which are moulded into the rod and whose axial length decreases toward the free end of the rod in order to prevent any axial displacement. This construction of the free rod end has proven effective, but is quite costly from the point of view of production engineering.

In French patent No. 1,197,548 prestressed steel rods for reinforced concrete are connected to a tension element by casings, featuring a longitudinal slot with an "inverted" saw tooth thread. In its boring, the casing is provided with teeth to improve the frictional connection with the tie rod. The thread, however, is steep and is not suitable for tightening under the influence of a load. To prevent an axial displacement of the casings on the steel rods, the rods are thicker at their ends.

SUMMARY OF THE INVENTION

It is an object of the invention to perfect an adhesive type blast hole anchor such that it may be produced in a simple manner. To achieve this object the supporting flanks of the saw tooth thread are shaped in a flat manner, whereby the tie rod is radially compressed when the nut is tightened. Experiments have shown that the transfer of forces within the tie rod is thus improved considerably, and that consequently a greater load can be transferred without any shearing off of the thread turns. The thread can either be cut directly into the tie rod, or it can be moulded into a casing that is either cast onto or adhered to the tie rod. In the latter case, the radial compression also considerably improves the transfer of forces between the casing and the tie rod.

DETAILED DESCRIPTION OF THE PREFERRED EMBODIMENTS

The anchor that is depicted is shaped in the form of an adhesive anchor. The tie rod 1 consists of a glass fiber reinforced, synthetic material. Two channels are cut into the end to be introduced into the blast hole, at an acute angle with the rod's axis, thereby providing two cutting edges 53 to cut open the plastic bags containing the two-component adhesive. This shape of the cutting edges ensures that the empty plastic bags are not wedged in, on one side, between the tie rod 1 and the wall of the blast hole.

Figure 1:
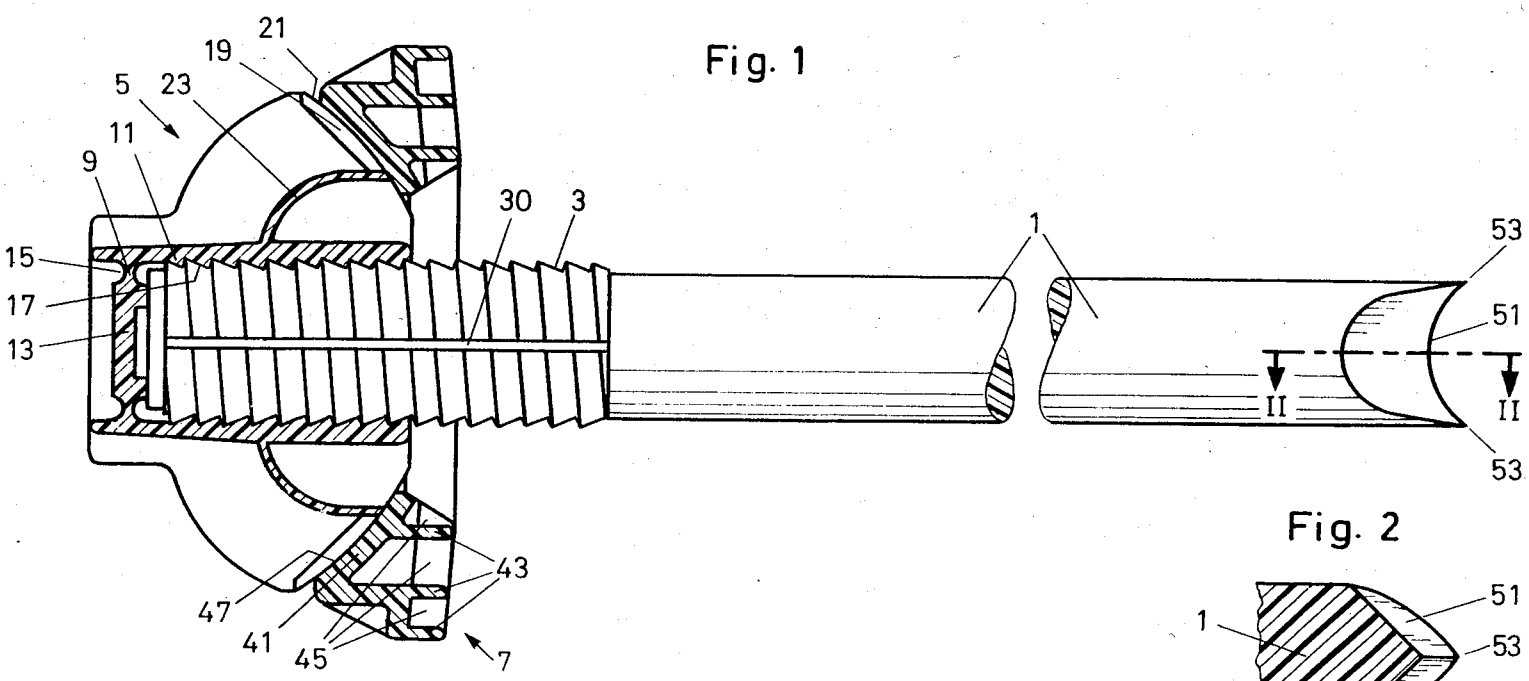
FIG. 1 is an axial section through an adhesive anchor.
Figure 2:
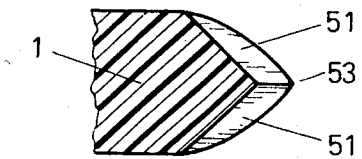
FIG. 2 is an axial section taken on line II—II, in FIG. 1.
Figure 3:
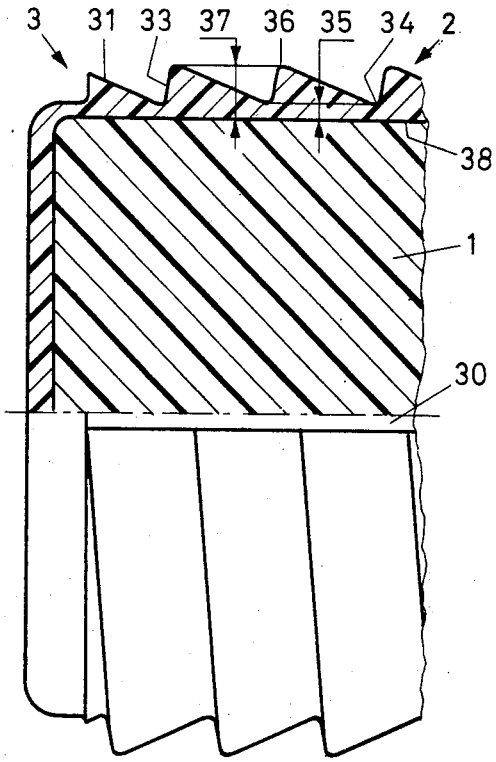
FIG. 3 is an enlarged cross-section through the rod end.

According to the embodiment depicted in FIGS. 1 and 3, a thread casing 3 consisting of glass fiber reinforced, synthetic material is provided at the free end of the tie rod 1. The thread is saw tooth shaped with flat flanks 31 inclined toward the end of the tie rod that will be introduced into the blast hole, and steep flanks 33 directed against the free end of the tie rod. This thread shape ensures that the thread turns of the casing 3 are wedged between the thread body 11 of a pressure nut 5 and the tie rod 1 when the nut is tightened. The thread turns are thus pressed radially against the tie rod. Experiments have shown that this radial pressing of the tie rod considerably improves not only the transfer of forces between the casing 3 and the tie rod, but also the transfer of forces within the tie rod itself.

The wall thickness 35 between the thread base 34 and the inner wall 38 of the casing 3 is extremely small, i.e. considerably less than the wall thickness 37 between the thread crests 36 and the inner wall 38. This ensures that the casing 3 is torn in a helical form along the thread base 34 when the tie rod is subjected to a strong extension. Since the individual thread turns of the casing 3 between the nut 5 and the tie rod 1 are wedged in, the transfer of forces is maintained and a separation of the tie rod from the casing 3, on the side of the blast hole, is prevented.

The casing 3 can be either cast onto or adhered to the tie rod 1. In the case of an extremely flat angle of the flanks 31, a press fit may also be sufficient under certain circumstances. The casing 3 has axial, longitudinal grooves or slots 30 so that a radial compression can never take place unhindered.

Figure 4:
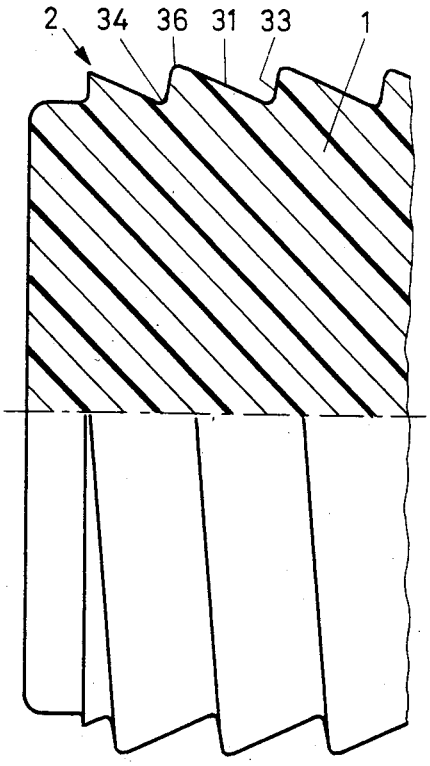
FIG. 4 is a variant of FIG. 3.
Figure 5:
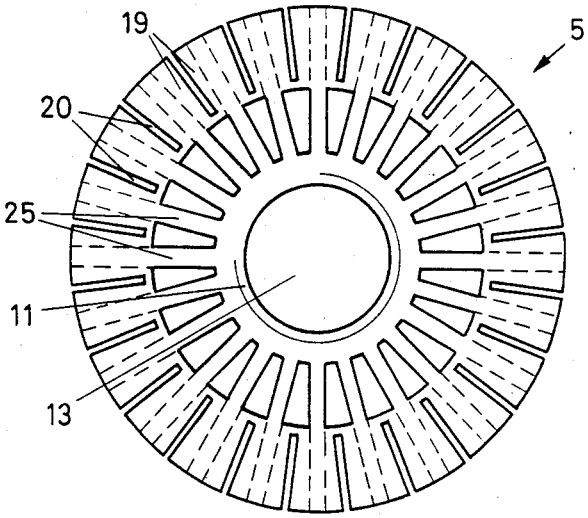
FIG. 5 is a frontal view of the pressure nut.

In the embodiment according to FIG. 4, the thread 2 is cut directly into the tie rod 1. Experiments have shown that the thread flanks 31, which are flat and face away from the free end of the rod, considerably improve the transfer of forces within the tie rod. The glass fibers, which are embedded in a synthetic resin matrix and run parallel to the rod's axis, cause a distinctive anisotrophy of the sturdiness values of the rod. The shearing stability parallel to the fibers is relatively low; it can, however, be increased considerably through radial compression. Consequently, the breaking load at which the thread turns shear off is considerably higher in the thread 2 according to the invention, than in a conventional thread.

The pressure nut 5 also consists of a glass fiber reinforced, synthetic material and has a cylindrical thread body 11, with radial ribs protruding from it. From the frontal aspect, the ribs 25 each end in a support flange segment 19 with a convex, spherical outer surface 21. The segments 19 are separated from one another by radial slots 20. This ensures the transfer of radial compression forces via the ribs 25 onto the thread body 11, originating from the bearing pressure acting upon the outer surfaces 21, the radial compression forces opposing the expanding forces of the saw tooth thread 2. The wall of the thread body 11 is thus compressed in a radial direction, resulting in an elastic elongation of the thread body in the direction of the axis and proportional to the load. By means of suitable dimensioning, this elastic elongation can be adapted to that of the tie rod 1 under the influence of a load, so that all thread turns bear an equal load. Thus, an ideal transfer of forces from the nut 5 to the tie rod 1 is achieved.

On the outside, the nut is sealed off by a cap or lid 13. Along the side of the lid there is an axial, circumferential groove 15. Between the base of the groove and the base of the thread boring 17, the wall thickness of the nut is extremely small to provide a predetermined breaking web 9. The breaking web is designed to be strong enough to transfer the torque required for the mixing of the two-component adhesive from the nut 5 to the tie rod 1. Upon the hardening of the adhesive and during the further turning of the nut 5, the web 9 ruptures so that the nut can be tightened.

The nut 5 is supported by an anchor plate 7, featuring a support flange 41 with a spherical bearing surface 47. Radial and ring-shaped ribs 45, 43 are integral with the support flange 41, thus forming a kind of crumple zone so that the support flange can lean against the wall of the hollow space for support, evenly and along its entire length. The spherical surfaces 21, 47 prevent a bending load on the tie rod 1.

The restriction of the insertion torque through the lid 13, which is connected with the thread body 11 by the breaking web 9, is applicable to adhesive anchors regardless of the thread form and the material of the tie rod 1. Because the maximum transferrable torque is relatively exactly defined by the breaking web, it is ensured that, on the one hand, the torque required for the mixing of the adhesive is sure to be generated, but that, on the other hand, the tie rod is not overstrained when the nut is turned further, after the adhesive has hardened.

What is claimed is:

1. An anchor device for securing hollow spaces such as blasting holes in a mine working or the like, comprising:

(a) an elongate tie rod (1) made of fiber reinforced synthetic material, (b) a saw tooth shaped thread (2) defined on an outer, free end of the rod, flanks (31) of the thread facing away from said free end being relatively flat and flanks (33) of the thread facing towards said firee end being relatively steep, (c) a centrally apertured washer plate (7) adapted to fit over the free end of the rod and bear against a wall of a mine working surrounding a hole into which the rod is inserted, and (d) a pressure nut (5) adapted to be secrewed onto the rod thread and bear against the washer plate, wherein axial compression force is transmitted along the flanks which face away from the free end.

2. Anchor device according to claim 1, wherein two channels (51) inclined toward the rod axis are defined on an inner end of the tie rod, the channels forming cutting edges (53) with the rod to rupture adhesive bags placed in a hole into which the rod is inserted.

3. Anchor device according to claim 1, wherein the free end of the tie rod has a saw tooth shape defining the saw tooth shaped thread.

4. Anchor device according to claim 1, further comprising a sleeve like casing (3) fitted over and attached to the tie rod, the outer surface of the casing having a saw tooth shape defining the saw tooth shaped thread.

5. Anchor device according to claim 4, wherein the casing has longitudinal slots (30) extending through the threads.

6. Anchor device according to claim 5, wherein the wall thickness (35) of the casing between the thread base (34) and an internal wall (38) of the casing is considerably smaller than the wall thickness (37) between the thread crests (36) and the internal wall to facilitate helical thread separation.

7. Anchor device according to claim 1, wherein the pressure nut has a cylindrical thread body (11), from which protrude radial ribs (25) which merge with convex spherical support flange segments (19) on frontal sides facing away from the free tie rod end, the segments separated from each other by radial slots (20).

8. Anchor device according to claim 7, wherein a central bore (17) of the thread body is sealed off on an outer end by a cap (13) connected with the thread body by a rupturable web (9).

9. Anchor device according to claim 8, wherein the web is formed by a circular groove (15) surrounding the cap.

* * * * *